US005875513A

United States Patent [19]

Reinold

[11] Patent Number: 5,875,513

[45] Date of Patent: Mar. 2, 1999

[54] FINGER-MOUNTED TOOTHBRUSH

[76] Inventor: Josef Reinold, Fritz-Börner-Strasse 20, 86929 Penzing, Germany

[21] Appl. No.: 894,661

[22] PCT Filed: Feb. 27, 1995

[86] PCT No.: PCT/EP96/00481

§ 371 Date: Aug. 22, 1997

§ 102(e) Date: Aug. 22, 1997

[87] PCT Pub. No.: WO96/26657

PCT Pub. Date: Sep. 6, 1996

[30] Foreign Application Priority Data

Feb. 27, 1995 [DE] Germany ..... 195 06 789.4

[51] Int. Cl.[6] ..... A46B 5/04; A46B 9/04

[52] U.S. Cl. ..... 15/227; 15/167.1; D4/103; D4/107

[58] Field of Search ..... 15/167.1, 227; 2/21; D4/103, 107

[56] References Cited

U.S. PATENT DOCUMENTS

| | | | |
|---|---|---|---|
| D. 362,118 | 9/1995 | Nelson | D4/103 |
| 2,075,681 | 3/1937 | Welker . | |
| 2,092,987 | 9/1937 | Remington | 15/227 |
| 2,101,363 | 12/1937 | De Rome | 15/227 |
| 2,686,325 | 8/1954 | Silver . | |
| 3,018,498 | 1/1962 | Wasserman . | |
| 4,620,528 | 11/1986 | Arraval | 15/227 |
| 5,107,562 | 4/1992 | Dunn | 15/167 A |

FOREIGN PATENT DOCUMENTS

| | | | |
|---|---|---|---|
| 575672 | 8/1924 | France | 15/227 |
| 71 19 54 | 9/1931 | France . | |
| 928115 | 5/1947 | France | 15/227 |
| 51 05 72 | 10/1930 | Germany . | |
| 32 28 679 | 2/1984 | Germany . | |
| 32 32 313 | 3/1984 | Germany . | |
| 34 29 655 | 2/1986 | Germany . | |
| 90 16 366 | 4/1991 | Germany . | |
| 4207864 | 9/1993 | Germany | 15/227 |
| 2043438 | 10/1980 | United Kingdom | 15/227 |
| 21 36 681 | 9/1984 | United Kingdom . | |

*Primary Examiner*—Randall E. Chin
*Attorney, Agent, or Firm*—Cohen, Pontani, Lieberman & Pavane

[57] ABSTRACT

A finger-mounted toothbrush, including a fingerstall-type elastic cap part with a slanted insertion opening that is mountable on a finger and has an inner side and a finger tip region with an action surface with substantially bristle-type cleaning elements. The cap part has an outer side with a length of approximately 0.5–2.5 cm. An at least partially resiliently elastic bar-shaped holding handle has a first end attached to the cap part so as to extend substantially along an inner side of the finger, and a second end. A single holding element is provided at the second end of the resiliently elastic holding handle so that when mounted on the finger, the holding handle with the holding element reaches substantially into a center of a user's palm.

17 Claims, 1 Drawing Sheet

FINGER-MOUNTED TOOTHBRUSH

BACKGROUND OF THE INVENTION

1. Field of the Invention

The invention relates to a finger-mounted toothbrush, as is used for tooth and gum care.

2. Description of the Prior Art

Careful teeth-cleaning technique and gum massage are known to be of special importance, particularly for persons with bleeding from the gums or tooth socket diseases (periodontal disease). Common injuries to the teeth and gums can be avoided by the use of a finger-mounted toothbrush. The sensitive touch of such a toothbrush promotes and simplifies a systematic tooth-cleaning technique. The feeling of a foreign body in the molar region that toothbrushes cause in some sensitive persons can be avoided. The finger-mounted toothbrush is especially suitable for gentle tooth cleaning and gum massage, especially after periodontal treatments.

A finger-mounted toothbrush of this type is known from German reference DE 32 32 313 A1, for example. The dental fingerstall described therein consists essentially of a rubber-type finger cover with an action surface of a certain shape and size, which is equipped with bristles or rounded rubber protuberances, as desired, and can be provided with medication. The action field, beginning at the finger pad, extends across the ungual phalanx and middle phalanx on the inner side of the finger, covering the entire width of the inner side of the finger in this region and running approximately another 5 mm along the lateral surfaces. The action field can be equipped with bristles 7 to 9 mm long or with rounded rubber protuberances 1 to 2 mm high or with rubber cups 4 to 5 mm high. It is true that the teeth and gums can be carefully treated with this thick dental fingerstall. In practice, however, handling the fingerstall is much too awkward or even impossible, since it is scarcely possible to simply slip the fingerstall over the index finger and then remove it again, especially when it is wet. Furthermore, if not placed securely enough on the index fingers for example, the fingerstall will slip in a twisting manner, so that the action field does not come to rest at the optimum location on the finger. For the same reason, the fingerstall can come off by itself in an uncontrolled manner, which can lead, especially in children, to unintentional swallowing of the dental fingerstall.

From German reference DE 34 29 655 A1, a fingerstall-type mouth cleaning device is known that also comprises a fingerstall made, for example, of rubber or ductile plastic. On its entire outer surface area, this device is equipped with bristles, which consist substantially of the same material as the fingerstall itself. The bristles are distributed in a varied manner around the circumference of the basic fingerstall. Short, softer bristles are arranged on the back of the fingerstall over a circumferential section of approximately 120°, being distributed in the manner of a dense pile. These short, softer bristles are intended to avoid irritating or even broaching the soft skin inside the mouth cavity while the teeth are actually being brushed. Harder bristles, directed toward the teeth, are arranged over the remaining 240°of the cross-sectional circumference and serve to clean the teeth. This known finger-mounted toothbrush does permit thorough and gentle teeth cleaning, but has the same disadvantages as the dental fingerstall described above, especially with respect to the awkward handling and inadequate safety.

From German reference DE 90 16 366 U1, a finger-mounted toothbrush is known that consists essentially of a cap, which can be placed upon a finger and to which teeth-cleaning bristles are attached. The cap can be a full cap or a half cap, the latter being held in place on the finger by holding means such as full rings or open rings. Furthermore, a cord can be attached to the cap to serve as a safety device. The cord is long enough to be wrapped around the hand in order to prevent the finger-mounted toothbrush from inadvertently sliding off and being swallowed. The interesting point is that this known cap does not extend past the first digital flexor and is equipped with natural or artificial bristles. This known toothbrush also has the disadvantages discussed above, and the cord provides safety only in a highly inadequate way. The cord provides no security against twisting.

German reference DE 32 28 679 A1 also describes a finger-mounted toothbrush, which has a cap part with stiff bristles on the inner side. A tongue-shaped inner carrier section, which is at least partially resistant to bending and is also equipped with bristles, is arranged on this cap part in a relatively flexible fashion. It is extended by a longer and narrower bar-like section, at the outer end of which there is a ring or ring section that encircles the finger. This known toothbrush also has the disadvantage of awkward handling. In addition, it must be matched relatively exactly in size to the finger of the user, especially in thickness and length, because optimal use is impossible if the fit is not secure enough.

In addition British reference GB 2 136 681A, U.S. Pat. No. 3,018,498 and U.S. Pat. No. 2,686,325, disclose finger-mounted toothbrushes are known that consist of fingerstalls with bristle-type or rounded-protuberance-type elements arranged on them, particularly on the inside. On the fingerstall side facing the hand, these finger-mounted toothbrushes also have a somewhat elongated region, which allows the fingerstall to be held in place with the thumb. When these known finger-mounted toothbrushes are used while being held by the thumb, i.e., to prevent slippage, difficulties arise in cleaning the back teeth, in particular, because the thumb creates space problems when inserted into the open mouth. Furthermore, the thumb becomes wet with saliva, toothpaste, etc. in an unpleasant and unhygienic manner.

It should also be noted that none of these known finger-mounted toothbrushes have draining measures. As a result , it is possible for saliva, water, toothpaste, etc. to run without obstruction along the finger and over the hand and from there onto the lower arm and clothing.

SUMMARY OF THE INVENTION

The object of the invention is to provide a finger-mount ed toothbrush of the aforementioned generic type, which permits simple and reliable handling and which, in particular, can be fitted and removed simply and reliably, is secured against twisting or slipping off while in use, and offers adequate protection against swallowing.

Accordingly, the finger-mounted toothbrush comprises a fingers-type cap part, which carries, at least on its inner side, an action surface with substantially bristle-type cleaning elements. A bar-like holding handle is attached to the cap part and extends along the finger inner side and carries a holding element. The essential point here is that the holding handle is resiliently elastic and when positioned properly for use, extends substantially into the palm of the user with a single holding element, which is provided at the free end. With the help of this handle, the fingerstall-like cap part is held by the thumb and/or other fingers during use, and always remains in place at a certain tension on the index finger or other finger used for cleaning. In this way, uncontrollable self-removal is prevented, while fitting and removal are carried out simply and reliably, especially with the help of the shaft. As a result, this finger-mounted toothbrush can be used even by clumsier persons and thus, in particular, by children. The cap part is prevented from slipping or twisting by means of the holding handle, so that a tight fit on the finger is no longer necessary and even a finger-mounted toothbrush with a somewhat looser cap part can be used just as safely and with good effect.

It is essential that the cap part have a length on the finger back of at least approximately 0.5–2.5 cm, preferably approximately 2 cm, as a result of which the cap part covers only the first phalanx, so that high mobility of the finger is maintained. As a result, the cleaning and massaging movements of the hand can be carried simply, with sensitivity and efficiency.

It is advantageous when the holding handle, depending on hand type and size (in particular, children's, women's or men's sizes and also delicate or stronger hands), is approximately 5 to 10 cm in length, and preferably approximately 6 to 8 cm for adults. Although a finger-mounted toothbrush with a longer holding handle can also be handled well, the toothbrush is easier to handle when the holding handle reaches only to the middle of the palm. This not only allows the shaft end to be better encompassed by the ball of the thumb, but also makes the device itself less cumbersome and therefore easier to store.

It is especially advantageous when the holding element has, at the end of the holding handle, an end thickening that, when the finger-mounted toothbrush is mounted on the finger, lies substantially in the center of the palm in a manner well-suited to the shape. This end thickening can have a spherical shape or can be a longitudinal or transversal oval thickening. A spherical shape, in particular, allows the holding handle end to be positioned in a manner especially adaptable to shape, so that the shaft end can be optimally grasped and held in a fixed position by the palm. In addition, with the help of the thumb, the spherical shape allows optimal tensile force to be placed on the shaft and thus on the cap part, so that the latter is always seated on the index finger at a certain tension.

According to another embodiment of the invention, the cap part has a length on the finger side that is approximately 0.5 to 4 cm longer than on the finger back. As a result, the cap part has a slanted insertion opening for the finger. Thanks to this slanted opening, the finger can slide into and out of the cap part more easily.

At the same time, a sufficiently large action surface remains available.

It has proved advantageous when the insertion-side end of the cap part is terminated by a substantially circular bulge. This bulge can also be embodied as a draining edge. This creates an especially good additional handling option. On the one hand, the bulge keeps the cap part open (maintaining the insertion position, which is at least slightly open). On the other hand, in its function as draining edge, the bulge prevents liquids, etc. from running along the hand and lower arm or into a sleeve, for example.

Furthermore, according to the invention, the holding handle can be adapted at its cap-side end to the curved shape of the insertion opening and can reach to about the half on the lateral finger surfaces at this end, encompassing this in a form-fitting and groove-like manner, while the holding handle narrows continuously in the direction of its holding end and passes over into the end thickening. In this way, the good fitting and insertion abilities of the toothbrush according to the invention can be improved even further.

The very good handling of the inventive toothbrush is also enhanced when the cap part has a grip elevation, located substantially on the finger back at the insertion end. The grip elevation can be embodied in the form of a transversal-bulge or, preferably, a nipple. The bulge-type grip elevation can be part of the circular termination bulge of the insertion opening, i.e., the termination bulge can be made somewhat easier to grip at this point, e.g., by being elevated and equipped with suitable gripping ridges. When a nipple serves as the grip elevation, said nipple can be spherical or button-shaped and can either be located on or as part of the termination bulge. Providing a grip elevation improves handling, so that the fitting and removal of the finger-mounted toothbrush according to the invention and, in particular, its accurate placement can be carried out quickly and simply.

In a further embodiment the termination bulge is, at least partly, also the termination or beginning part of the holding handle. In this case, the bulge can be made of the same material as the holding handle, at least to the length of the circumferential extension of the shaft end on the cap side, while the remainder of the bulge, i.e., the part of the bulge that covers the back of the finger, can be made of the same flexible material as the cap part. However, the entire bulge can also be produced from the flexible cap material, a matter that can be left, in terms of production technology, to the appropriate expert.

The cap part, which is made of relatively thin rubber-elastic material, has an action surface, which preferably extends over the finger tip to the finger back and also covers the lateral finger surfaces approximately halfway. This gives the action surface an optimal extent or arrangement, so that the properly placed finger-mounted toothbrush can be used optimally.

It is also advantageous when the cleaning elements on the action surface of the cap part are matched to their particular usage, e.g., embodied as stiff bristles, as interwoven loops or as rubber-elastic tufts. In each case, the cleaning elements are preferably approximately 4 mm long. This length, in combination with the appropriate material and other cross-sectional design of the cleaning elements, results in particular suitability to clean the teeth or massage the gums or both.

When the cleaning elements on the action surface are embodied as interwoven loops, these can be textile loops, plastic loops or loops or any other suitable material, which are worked or embedded directly into the thin, elastic base material of the cap part, for example. In this way, an action surface with a terry cloth quality is created, which, as is known, is used widely and effectively in the personal care field in a wide variety of soft or harder grades for various massage purposes.

The arrangement and/or shaping of, in particular, the action surface, the termination bulge (straight, slanted or curved) and the holding handle, seen individually or in interaction with each other, can be designed not only to optimize function but also to achieve artistic ends. For example, in the case of finger-mounted toothbrushes for children, the cap part with its action part could be designed to resemble a colorful animal figure or comic face, combining graphic and three-dimensional elements. This will create greater incentive for use.

The invention is described in greater detail below in reference to example.

DETAILED DESCRIPTION OF THE PREFERRED EMBODIMENTS

Figure 1:
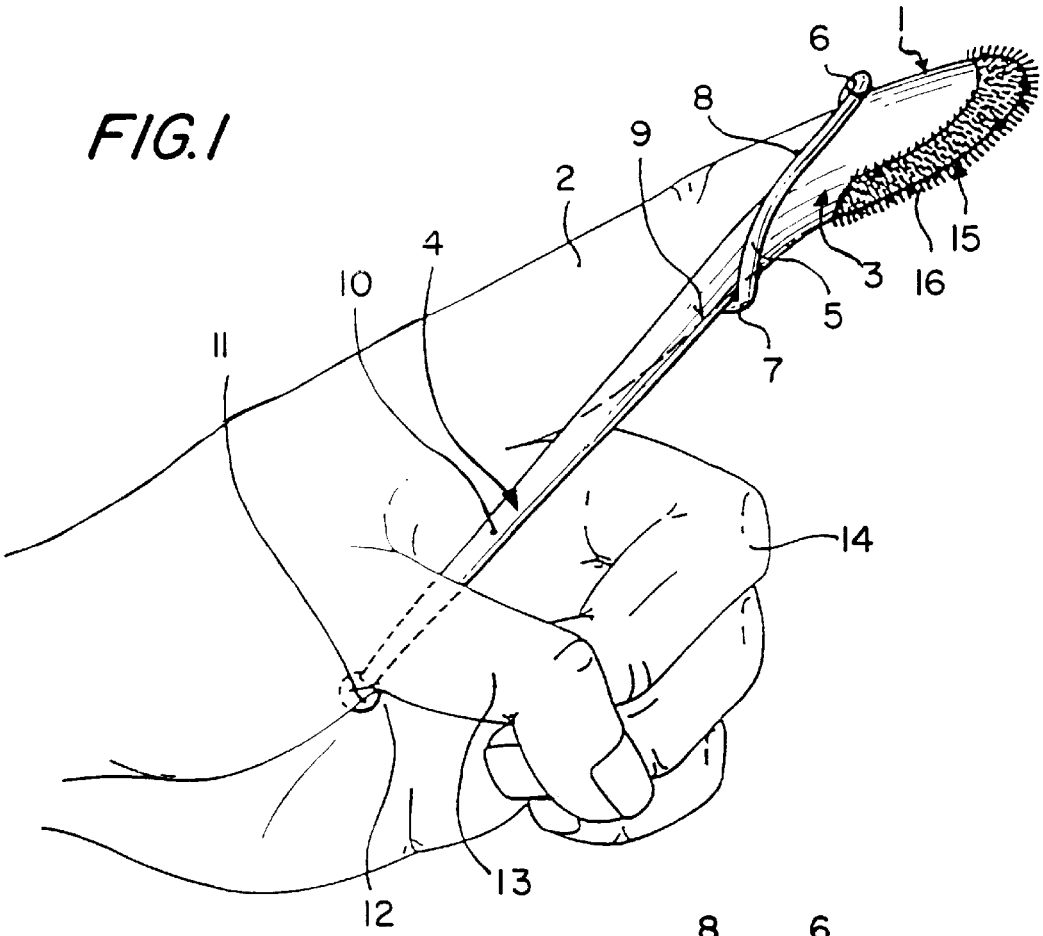
FIG. 1 a finger-mounted toothbrush according to the invention, placed on the index finger in position for use, in a basic embodiment.

The side view in FIG. 1 shows a finger-mounted toothbrush according to the invention mounted on an index finger 2. It can be seen that the finger-mounted toothbrush 1 consists of two basic components, i.e., an upper cap part 3, which is substantially fingerstall-shaped, and a longer holding handle 4, which continues on the inner side of the finger in longitudinal extension. The cap part 3 is terminated at its insertion end by means of a termination bulge 5, which at the same time forms the partial beginning of the holding handle 4. The termination bulge 5 has a grip elevation, located at its end on the finger back, in the form of a substantially spherical nipple 6. The nipple 6 serves to make handling easier, especially when the cap part 3 or the entire finger-mounted toothbrush is being slipped on or off.

The termination bulge 5 has a molded-on draining edge 7, which effectively prevents fluids located in the mouth from flowing down along the holding handle 4 and the finger 2 onto the hand and beyond.

The cap part 3, together with its termination bulges, is designed and arranged in such a fashion that there is a slanted insertion opening 8. The slant of the openings, whose slightly curved shape improves the drainage effect to a certain extent, continues at the beginning of the holding handle 4, which passes practically seamlessly into the cap part 3 via the bulge 5 or is securely connected to the cap 3.

Figure 2:
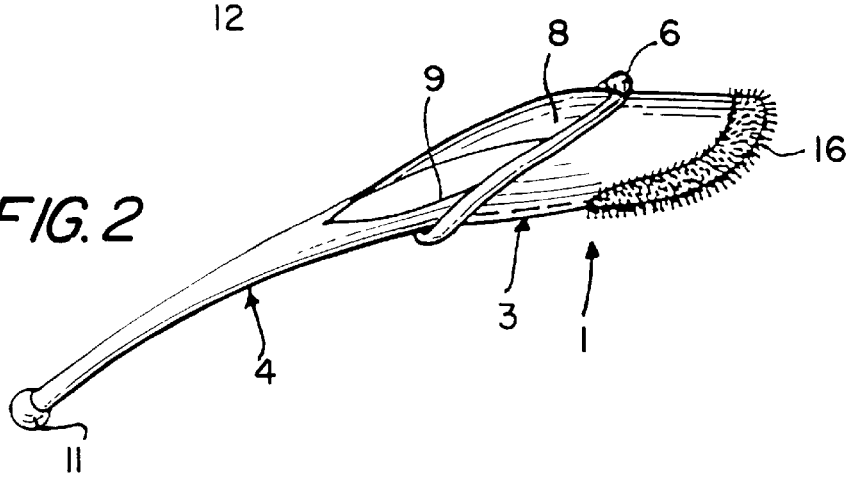
FIG. 2 a finger-mounted toothbrush as in FIG. 1 removed from the finger, from another perspective.

At its upper, cap-side end, the holding handle 4 is adapted to the shape of the cap 3 or to the shape of the inserted finger 2, so that the shaft, at least on this side, has the form of at least a partial groove 9, which is shown by broken lines in FIGS. 1 and 2 only. The groove 9 also serves to substantially ease insertion and removal, in that the finger is first placed into the firm groove 9 and then slipped along the latter into the interior of the cap part 3.

As the drawing shows, the holding handle 4 then passes from its groove-like form into a more and more rounded shape, forming the actual shaft 10, which reaches into the palm 12, where it ends in a sphere 11. The end of the shaft 10 with the sphere 11 is held in the palm 12 by the thumb 13 or other fingers 14 in such a way that the cap part 3 sits tautly and in the correct position.

The cap part 3 has an action surface 15, which covers the underside of the finger to at least the length of the first finger flexor and, at the same time, covers the lateral surfaces and the finger tip to the finger back. In the embodiment shown in the drawing, the action surface 15 is equipped with the interwoven loops 16.

Figure 3:
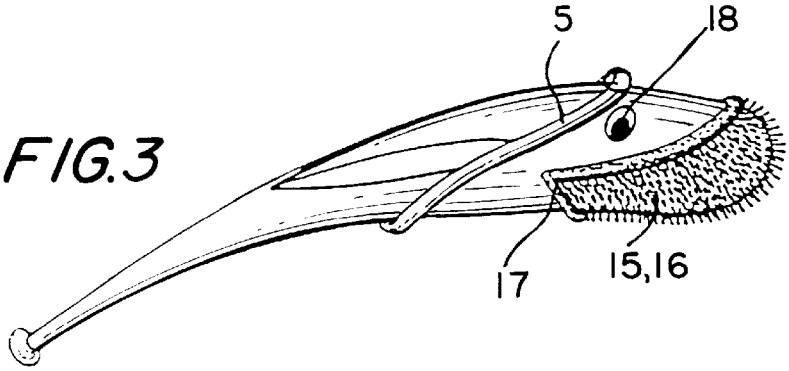
FIG. 3 a finger-mounted toothbrush in the same view as in FIG. 2, but in an embodiment designed especially as a tooth-cleaning animal for children.

The example shown in FIG. 3 differs from those in FIGS. 1 and 2 only in that an artistic design has been added. The action surface 15 is bordered by a colored line 17 or by an appropriate application of material, preferably differentiated by color, of the same flexibility as the basic cap material. Here, the colored line 17 represents the contour of the lips of an animal, e.g., a shark, while the interwoven loops 16 of the action surface 15 are meant to represent the shark's open mouth with teeth, etc. In addition, painted or stuck-on eyes 18 and, in particular, the coloring and shaping of the termination bulge 5, can heighten the desired aesthetic effect.

It is claimed:

1. A finger-mounted toothbrush, comprising:

a fingerstall-type elastic cap part with a slanted insertion opening that is mountable on a finger and has an inner side and a finger tip region with an action surface with substantially bristle-type cleaning elements, the cap part having an outer side with a length of approximately 0.5–2.5 cm;

an at least partially resilient elastic bar-shaped holding handle having a first end attached to the cap part so as to extend substantially along an inner side of the finger, and a second end; and a single holding element provided at the second end of the resilient elastic holding handle so that when mounted on the finger, the holding handle with the holding element reaches substantially into a center of a user's palm, the first end of the holding handle being formed to conform to the insertion opening, the holding handle being configured at the first end, to conform to the shape of the finger and simultaneously to the insertion opening, as a groove that tapers out as a shaft that becomes continuously narrower toward the second end, the groove being configured to extend approximately halfway up lateral surfaces of the finger.

2. A finger-mounted toothbrush as defined in claim 1, wherein the outer side of the cap part has a length of approximately 2 cm.

3. A finger-mounted toothbrush as defined in claim 1, wherein the holding handle is formed to substantially conform to basic hand types and has a length of approximately 5–10 cm, the holding element at the second end of the holding handle being an end thickening shaped as one of a sphere and an oval.

4. A finger-mounted toothbrush as defined in claim 3, wherein the holding handle has a length of approximately 6–8 cm.

5. A finger-mounted toothbrush as defined in claim 1, wherein the cap part is made of relatively thin rubber-elastic material and the action surface on the cap part extends over the finger tip region to the outer side and laterally half way up the finger.

6. A finger-mounted toothbrush as defined in claim 5, wherein the cleaning elements on the action surface are one of bristles and interwoven loops with a length of approximately 4 mm.

7. A finger-mounted toothbrush as defined in claim 5, wherein the cleaning elements are rubber elastic tufts with a length of approximately 4 mm.

8. A finger-mounted toothbrush as defined in claim 5, wherein the cleaning elements are interwoven loops that include loops approximately 4 mm in length that are at least one of directly worked and embedded in the relatively thin elastic material of the cap part.

9. A finger-mounted toothbrush, comprising:

a fingerstall-type elastic cap part with a slanted insertion opening that is mountable on a finger and has an inner side and a finger tip region with an action surface with substantially bristle-type cleaning elements, the cap part having an outer side with a length of approximately 0.5–2.5 cm;

an at least partially resilient elastic bar-shaped holding handle having a first end attached to the cap part so as to extend substantially along an inner side of the finger, and a second end;

a single holding element provided at the second end of the resilient elastic holding handle so that when mounted on the finger, the holding handle with the holding element reaches substantially into a center of a user's palm, the inner side of the cap part being approximately 0.5–4 cm longer than the outer side so as to form the slanted insertion opening of the cap part; and a substantially circular termination bulge provided on the cap part so as to border the insertion opening, the cap part having a grip elevation formed as a transversal bulge on the outer side and adjacent the insertion opening.

10. A finger-mounted toothbrush as defined in claim 9, wherein the grip elevation is part of the termination bulge.

11. A finger-mounted toothbrush as defined in claim 9, wherein the outer side of the cap part has a length of approximately 2 cm.

12. A finger-mounted toothbrush as defined in claim 9, wherein the holding handle is formed to substantially conform to basic hand types and has a length of approximately 5–10 cm, the holding element at the second end of the holding handle being an end thickening shape is one of a sphere and an oval.

13. A finger-mounted toothbrush as defined in claim 9, wherein the cap part is made of a relatively thin rubber-elastic material and the action surface on the cap part extends over the finger tip region to the outer side and laterally half-way up the finger.

14. A finger-mounted toothbrush as defined in claim 9, wherein the termination bulge has a draining edge.

15. A finger-mounted toothbrush as defined in claim 9, wherein the grip elevation is arranged on the termination bulge.

16. A finger-mounted toothbrush as defined in claim 15, wherein the termination bulge is a terminating part of the holding handle.

17. A finger-mounted toothbrush as defined in claim 9, wherein the termination bulge is a terminating part of the holding handle.

* * * * *